US011173720B2

(12) United States Patent
Hettler et al.

(10) Patent No.: US 11,173,720 B2
(45) Date of Patent: Nov. 16, 2021

(54) INK SUPPLY SYSTEM FOR A PRINT BAR OF AN INKJET PRINTING DEVICE WITH PRESSURE STABILIZATION

(71) Applicant: Canon Production Printing Holding B.V., Venlo (NL)

(72) Inventors: Wolfgang Hettler, Feldkirchen (DE); Florian Hitzlsperger, Poing (DE); Christoph Rummelsberger, Ismaning (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/815,380

(22) Filed: Mar. 11, 2020

(65) Prior Publication Data

US 2020/0290364 A1 Sep. 17, 2020

(30) Foreign Application Priority Data

Mar. 12, 2019 (DE) ..... 102019106200.4

(51) Int. Cl.
*B41J 2/175* (2006.01)

(52) U.S. Cl.
CPC ..... *B41J 2/17596* (2013.01)

(58) Field of Classification Search
CPC .... B41J 2/17596; B41J 2/17593; B41J 2/175; B41J 2/18
USPC ..... 347/20, 54, 68, 84, 85
See application file for complete search history.

(56) References Cited

U.S. PATENT DOCUMENTS

| | | | | |
|---|---|---|---|---|
| 4,234,885 | A | 11/1980 | Arway | |
| 6,561,608 | B1 | 5/2003 | Yamamoto et al. | |
| 7,828,425 | B2 * | 11/2010 | Kang | B41J 2/19 347/93 |
| 9,067,428 | B2 * | 6/2015 | Matsumoto | B41J 2/17566 |
| 10,124,597 | B2 * | 11/2018 | Alessi | B41J 2/175 |
| 10,919,308 | B2 * | 2/2021 | Hitzlsperger | B41J 2/17596 |
| 2014/0247313 | A1 | 9/2014 | Matsumoto et al. | |
| 2016/0075144 | A1 | 3/2016 | Sugitani et al. | |

FOREIGN PATENT DOCUMENTS

| | | |
|---|---|---|
| DE | 30 33 352 A1 | 3/1981 |
| DE | 699 18 937 T2 | 7/2005 |
| EP | 1 839 867 B1 | 8/2015 |

OTHER PUBLICATIONS

German Office Action dated Nov. 4, 2019, for Application No. 10 2019 106 200.4.

* cited by examiner

*Primary Examiner* — An H Do
(74) *Attorney, Agent, or Firm* — Schiff Hardin LLP

(57) ABSTRACT

An ink supply system for a print bar of an inkjet printing device includes two supply lines that travel along the longitudinal axis of the print bar and direct ink with opposite flow direction. The print heads of the print bar are respectively connected to both supply lines via a connecting line in order to supply ink to said print heads. A uniform mean hydraulic pressure is produced in all print heads via the opposite flow directions in the two supply lines.

17 Claims, 3 Drawing Sheets

INK SUPPLY SYSTEM FOR A PRINT BAR OF AN INKJET PRINTING DEVICE WITH PRESSURE STABILIZATION

CROSS REFERENCE TO RELATED APPLICATIONS

This patent application claims priority to German Patent Application No. 102019106200.4, filed Mar. 12, 2019, which is incorporated herein by reference in its entirety.

BACKGROUND

Field

The disclosure relates to an ink supply system for supplying the print heads of a print bar of an inkjet printing device with ink.

Related Art

An inkjet printing device for printing to a recording medium may comprise a print bar with a plurality of print heads respectively having one or more nozzles. The nozzles are respectively configured to eject ink droplets in order to print dots of a print image onto the recording medium.

To supply the individual print heads with ink, ink may be supplied from an ink container to the individual print heads via supply lines. The supply lines thereby typically have different lengths due to different distances of the individual print heads from the ink container. The supply lines of different lengths may lead to the situation that the ink in the individual print heads has different physical pressures. This may lead to differences in the sections of a print image that are printed by the individual print heads. Furthermore, nozzle failures may occur at individual print heads due to disadvantageous conditions with respect to the physical pressure of ink.

Document US 2016/0075144A1 discloses an ink transport system operated with compressed air. Document DE 30 33 352 A1 describes a fluid flow arrangement having a pressure equalization valve. Document DE 699 18 937 T2 describes a method and a device for printing a plurality of inks from a print nozzle with consistent total flow throughput. Document EP 1 839 867 B1 discloses a print head having a flexible film that seals an ink flow channel and reduces pressure fluctuations in the ink flow channel Document US 2014/0 247 313 A1 discloses an ink supply system for print heads of a printing device.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
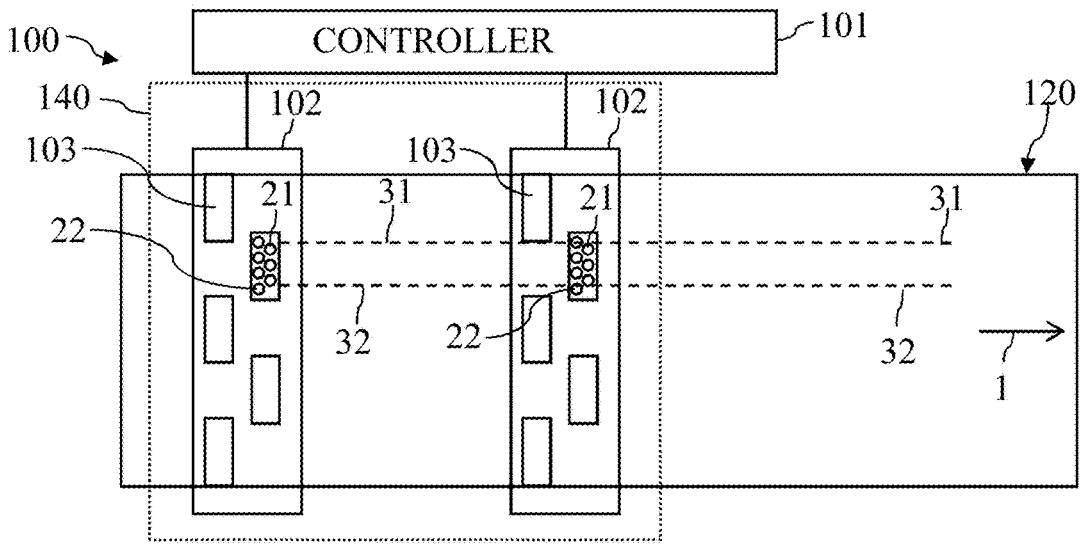
FIG. 1 illustrates an inkjet printing device according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure provides uniform conditions with regard to the physical pressure of ink in the print heads of a print bar, in particular in order to avoid nozzle failures and/or to produce a uniform print quality.

According to one aspect of the disclosure, an ink supply system is described for an inkjet printing device. The printing device comprises a print bar having a plurality of print heads that are arranged at different positions along a longitudinal direction of the print bar, between a first side and a second side of said print bar. The ink supply system comprises a first and second supply line that respectively travel along the longitudinal direction. Moreover, the ink supply system comprises a plurality of connecting lines that respectively connect the first and second supply line with one another at the different positions, and which are configured to supply ink from the first and/or second supply line to the print heads. The ink supply system also comprises at least one container for ink, as well as at least one transport means which is configured to transport ink from the container along a first flow direction from the first side to the second side via the first supply line, and along a second flow direction from the second side to the first side via the second supply line.

The printing device (i.e. printer) 100 depicted in FIG. 1 is designed for printing to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed along the transport direction 1 (represented by an arrow) through the print group 140 of the printing device 100.

In the depicted example, the print group 140 of the printing device 100 includes two print bars 102, wherein each print bar 102 may be used for printing with ink of a defined color (for example black, cyan, magenta, and/or yellow, and if applicable MICR ink). Different print bars 102 may be used for printing with respective different inks. Furthermore, the printing device 100 typically includes at least one fixing unit (fixer) or drying unit (dryer) (not shown) that is configured to fix a print image printed on the recording medium 120.

In an exemplary embodiment, a print bar 102 includes one or more print heads 103 that, if applicable, are arranged side by side in a plurality of rows in order to print the dots of different columns 31, 32 of a print image onto the recording medium 120. In the example depicted in FIG. 1, a print bar 102 includes five print heads 103, wherein each print head 103 prints the dots of one group of columns 31, 32 of a print image onto the recording medium 120. The number of print heads 103 of a print bar 102 may be 5, 10, or more, for example.

In the embodiment depicted in FIG. 1, each print head 103 of the print group 140 includes a plurality of nozzles 21, 22, wherein each nozzle 21, 22 is configured to fire or eject ink droplets onto the recording medium 120. A print head 102 of the print group 140 may, for example, include multiple thousands of effectively utilized nozzles 21, 22 that are arranged along multiple rows transversal to the transport direction 1 of the recording medium 120. By means of the nozzles 21, 22 of a print head 103 of the print group 140, dots of a line of a print image may be printed on the recording medium 120 transversal to the transport direction 1, meaning along the width of the recording medium 120.

In an exemplary embodiment, the printing device 100 includes a controller 101, for example an activation hardware and/or a processor, that is configured to control the actuators of the individual nozzles 21, 22 of the individual print heads 103 of the print head 140 in order to apply the print image onto the recording medium 120 depending on print data. In an exemplary embodiment, the controller 101 includes processor circuitry that is configured to perform one or more functions/operations of the controller 101, including controlling the actuators of the individual nozzles 21, 22 and/or the overall operation of the printer 100 (including the operation of one or more components of the printer 100).

In an exemplary embodiment, the print group 140 of the printing device 100 includes at least one print bar 102 having K nozzles 21, 22 (which may be arranged in one or more print heads 103) that may be activated with a defined line clock cycle in order to print a line, said line traveling transversal to the transport direction 1 of the recording medium 120, with K pixels or K columns 31, 32 of a print image onto the recording medium 120, for example with K>1000. In the depicted example, the nozzles 21, 22 are installed immobile or fixed in the printing device 100, and the recording medium 120 is directed past the stationary nozzles 21, 22 with a defined transport velocity.

Figure 2:
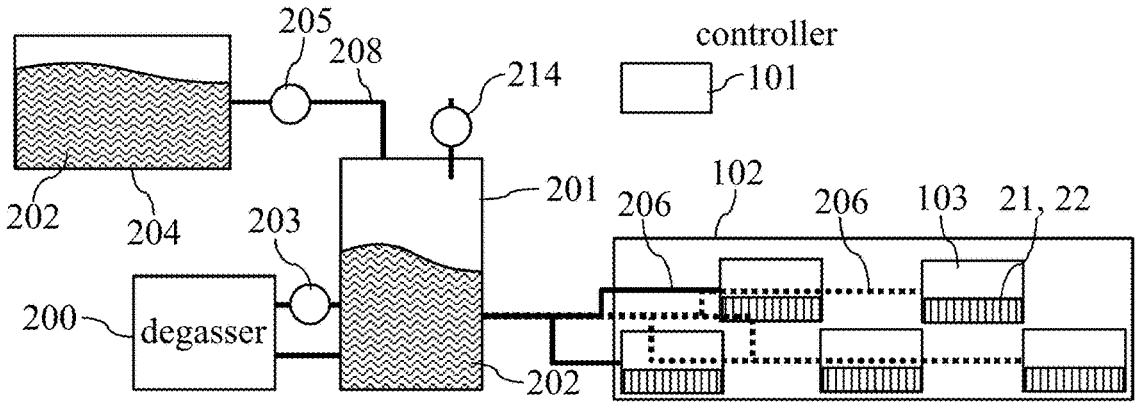
FIG. 2 illustrates an ink supply of the print heads of a print bar of an inkjet printing device according to an exemplary embodiment of the present disclosure.

FIG. 2 shows the ink supply of an example of a print head 103 according to an exemplary embodiment. With the ink supply depicted in FIG. 2, the one or more print heads 103 of a print bar 102 may be supplied with ink 202 of a defined ink type, for example of a defined color. The ink supply depicted in FIG. 2 may respectively be provided for each print bar 102 and/or for each employed ink type of a printing device 100.

In an exemplary embodiment, ink 202 may be supplied to the individual nozzles 21, 22 of a print head 103 via an ink supply channel 206. The ink supply channel 206 may thereby draw the ink 202 from a negative pressure vessel or backpressure vessel 201. The negative pressure vessel 201 may in turn be supplied with ink 202 from a supply container 204 via an ink supply channel 208. The ink 202 may thereby be transported from the supply container 204 into the negative pressure vessel 201 by means of a supply transport pump 205. In an exemplary embodiment, the negative pressure vessel 201 is used to adjust a defined physical negative pressure within the individual nozzles 21, 22 of the print heads 103. Via this physical negative pressure it may be ensured that no ink 202 escapes from the nozzles 21, 22 during the printing operation of the printing device 100. Furthermore, the physical negative pressure may have the effect that an ink meniscus forms at the output of a nozzle 21, 22, which meniscus may be set in motion by an actuator of the nozzle 21, 22, for example by a piezoelectric element actuator, in order to push an ink droplet out of the nozzle 21, 22. In a pressure phase, the physical (negative) pressure in the nozzles 21, 22 of a print head may be set at a printing operation level (for example −30 mbar, −20 mbar, −10 mbar, or (in absolute terms) less, for instance −3 mbar). The printing operation level is thereby typically such that, on the one hand, an escape of ink 202 from the nozzles 21, 22 is avoided and such that, on the other hand, a suction of air into the nozzles 21, 22 is avoided.

The printing operation level may be set mechanically via the height difference between the nozzle plate of the print heads 103 and the fill level of the negative pressure vessel 201. The fill level of the negative pressure vessel 201 may thus be adjusted, in particular regulated, to a defined fill level value to adjust the pressure in the nozzles 21, 22 to a defined printing operation level. Alternatively or additionally, the pressure or negative pressure in the negative pressure vessel 201 may be adjusted via a pressure pump 214.

The ink 202 provided via the ink supply channel 206 may beforehand travel through a degasser 200 to reduce the gas content of the ink 202. In particular, ink 202 may be pumped by means of a degassing transport pump 203 from the negative pressure vessel 201, through the degasser 200, and back again into the negative pressure vessel 201. The gas content of the ink 202 within the negative pressure vessel 201, and thus the gas content of the ink 202 provided to a print head 103, may thus be reduced.

A defined physical negative pressure (for example −3 mbar) should respectively be set at the individual nozzles 21, 22 of the print heads 103 of a print bar 102. The negative pressure should (in absolute terms) be sufficiently large in order to prevent an escape of ink from the individual nozzles 21, 22. Furthermore, the negative pressure should (in absolute terms) be sufficiently small in order to prevent air from being drawn through the nozzles 21, 22 into the interior of a print head 103. These conditions with regard to the negative pressure should be satisfied in all phases of the printing operation of a print head 103.

The printing operation of a print head 103 is a dynamic process. Depending on the print load of the print head 103, the actuators of the individual nozzles 21, 22 of the print head 103 pump ink 202 from the print head 103, or the actuators of the individual nozzles 21, 22 of the print head 103 stop the existing ink flow (which thereby leads to what is known as the water hammer effect in the supply channel 206 of the print head 103). In particular, for an ink ejection the individual nozzles 21, 22 respectively generate an overpressure which abates again after ejection of an ink droplet, which leads to the situation that ink 202 is resupplied from the negative pressure vessel 201 into the print head 103. The physical pressure within a print head 103 thus varies as a result of the operation of the actuators of the individual nozzles 21, 22. Therefore, within the scope of the printing operation of a print head 103, pressure spikes may occur that may possibly lead to the failure of nozzles 21, 22 of the print head 103.

With increasing age, or with an increasing number of operating hours, print heads 103 typically become more sensitive to pressure fluctuations, in particular since the anti-wetting material on the nozzle plate of a print head 103 is worn away over time due to mechanical stress, and therefore the retention force that is produced by the anti-wetting material for ink 202 is lost, which may lead to the leaking of ink 202 during the operation of a print head 103.

As is to be learned from FIG. 2, the print heads 103 of a print bar 102 are supplied with ink 202 from a common container 201, for example via a distributor. Each print head 103 thereby has a supply channel 206, wherein the supply channels 206 are of different lengths depending on the position of the respective print head 103, and thus pressure drops of different magnitudes occur at the supply channels 206 of different lengths. The supply channels 206 of different lengths therefore typically lead to pressure spikes that are more strongly or weakly pronounced.

Figure 3:
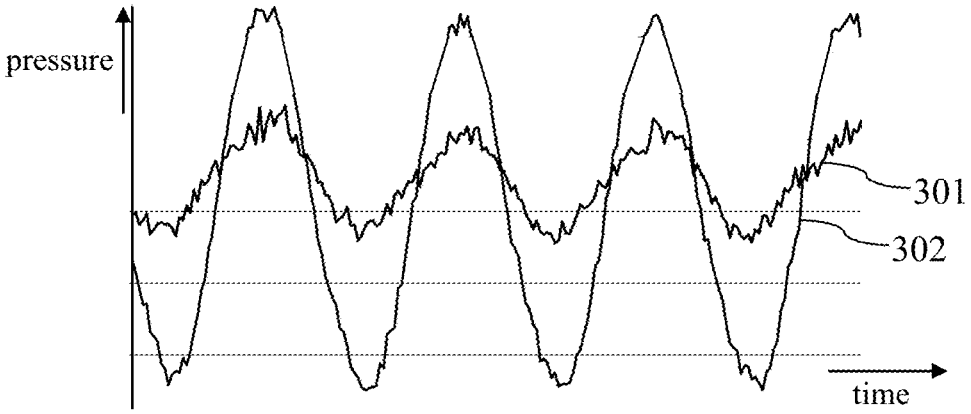
FIG. 3 illustrates a plot of pressure curves over time in different print heads of a print bar according to an exemplary embodiment of the present disclosure.

FIG. 3 shows the time curve 301 of the physical pressure in a print head 103 having a relatively short supply channel 206, and the time curve 302 of the physical pressure in a print head 103 having a relatively long supply channel 206. As is apparent from FIG. 3, the amplitude of the pressure spikes increases with increasing length of the supply channel 206, such that a print head 103 having a relatively long supply channel 206 has an increased risk of nozzle failure.

In an exemplary embodiment, in order to damp pressure spikes, a central, air-filled damper may be provided within the scope of the ink supply. If applicable, an air-filled damper may also be provided for each print head 103. However, the use of one or more dampers is insufficient in particular given print bars 102 having a relatively high number of print heads 103 (for example having 10 or more print heads 103).

Figure 4:
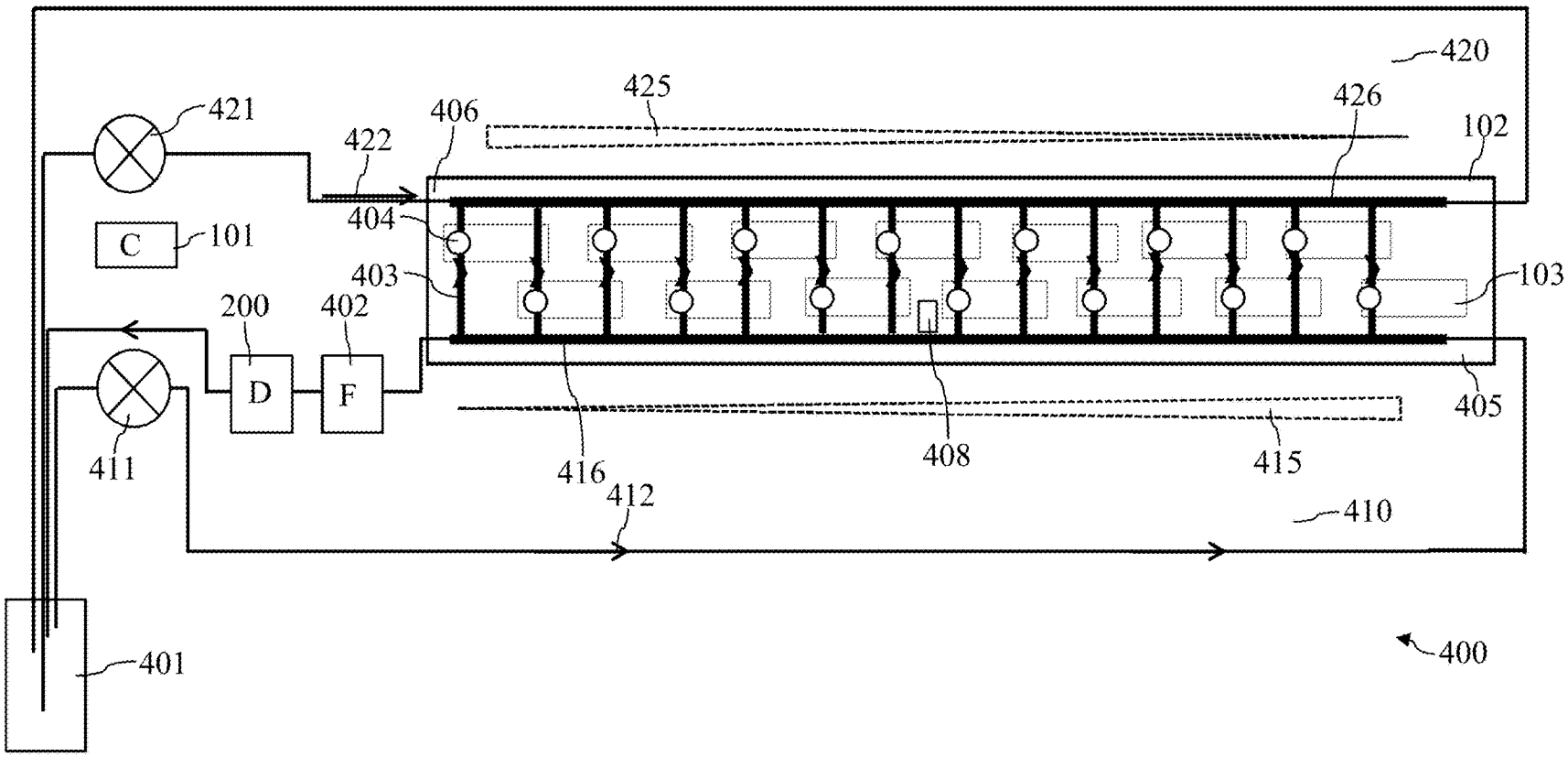
FIG. 4 illustrates an ink supply system for a print bar of an inkjet printing device according to an exemplary embodiment of the present disclosure.

FIG. 4 shows an ink supply system 400 for supplying the print heads 103 of a print bar 102 with ink 202. In FIG. 4, fourteen print heads 103 are shown in total. The print heads 103 are arranged one after another or successively within the print bar 102, starting from the first (for example the right) side 405 up to the second (for example the left) side 406 of said print bar 102. The print heads 103 may thereby at least partially overlap if they are arranged offset from one another (for example in two different rows).

In an exemplary embodiment, the system 400 has two supply loops 410, 420 for ink 202, where both loops 410, 420 may possibly be supplied with ink 202 from a common container 401. The first supply loop 410 has a first supply line 416 that extends from the first side 405 of the print bar 102 up to the second side 406 of the print bar 102 along the print heads 103, and through which ink 202 flows in the first direction 412 (meaning from the first side 405 to the second side 406). The ink 202 is thereby pumped by a first transport means 411 (in particular by a first pump) from the container 401 into the first loop 410, through the first supply line 416, and back into the container 401.

In a corresponding but opposite way, the second supply loop 420 has a second supply line 426 that extends from the second side 406 of the print bar 102 up to the first side 405 of the print bar 102 along the print heads 103, and through which ink 202 flows in the second direction 422 (meaning from the second side 406 to the first side 405). The ink 202 is thereby pumped by a second transport means 421 (in particular by a second pump) from the container 401 into the second loop 410, through the second supply line 426, and back into the container 401.

The two supply lines 416, 426 travel parallel to one another and are connected with one another via cross lines or connecting lines 403, so that a structure of lines 416, 426, 403 results that has the form of a ladder, wherein the connecting lines 403 form the rungs of the ladder. For each print head 103 of the print bar 102, a connecting line 403 (possibly precisely one) may be provided so that each print head 103 is connected via a corresponding connecting line 403 in order to supply the respective print head 103 with ink 202. FIG. 4 shows the connections of 404 of the individual print heads 103 to the individual connecting lines 403.

In the exemplary embodiment depicted in FIG. 4, the first loop 410 has a degasser 200 as well as a filter 402 for filtering ink 202. The use of a single degasser 200 and/or of a single filter 402 is typically sufficient in order to degas or, respectively, to filter the ink 202 being drawn from a common container 401. The degasser 200 and/or the filter 402 may thereby be arranged downstream or upstream in relation to a print bar 102. Alternatively or additionally, the second loop 402 may have a degasser 200 and/or a filter 402.

The physical pressure (i.e. the hydraulic pressure) of ink 202 in the supply lines 416, 426 typically decreases with increasing distance from the respective transport means 411, 421. The physical pressure in the first supply line 416 thereby decreases along the first direction 412 (represented by the dashed acute triangle 415), whereas the physical pressure in the second supply line 426 decreases along the second direction 422 opposite thereto (represented by the dashed acute triangle 425).

The individual connecting lines 403 are respectively coupled at a respective first end with the first supply line 416, and respectively coupled at a respective second end with the second supply line 426. The ink 202 in the first supply line 416 thereby has a relatively high physical pressure at the first side 405 of the print bar 102, whereas the ink 202 in the second supply line 426 has a relatively low physical pressure. At the second side 406 of the print bar 102, the situation is precisely the opposite, meaning that the second supply line 426 has a relatively high physical pressure there, whereas the first supply line 416 has a relatively low physical pressure there. These pressure differences are compensated in the individual connecting lines 403 so that a uniform physical pressure is present in the individual connecting lines 403, and so that ink 202 is supplied to the individual print heads 103 via the respective connector 404 with uniform pressure conditions across all print heads 103. In particular, via such an ink supply system 400 the same physical pressure of ink 202 may be set in all print heads 103 of a print bar 102 (for example a physical pressure that in all print heads 103 deviates by less than 10% from a defined and/or mean printing operation level).

An ink supply system 100 is thus described that has two contradirectional ring lines 410, 420. For example, the pressure drop in the supply lines 416, 426 from one side 405 of the print bar 102 to the other side 406 of said print bar 102 may thereby amount to 120 mbar given fourteen or fifteen print heads 103. Via the contradirectional supply lines 416, 426, a print head 103 on the first side 405 of the print bar 102 experiences a relatively high physical pressure from the first supply line 416 at the first side 405 of the print bar 102 and a relatively low physical pressure from the second supply line 426. The situation is exactly reversed at the second side 406 of the print bar 102. This means that, on average, the same supply pressure is applied to each print head 103 of the print bar 102.

The physical pressure in the print heads 103 may be set, in particular regulated, via operation of one or more transport means 411, 421, for example to a target value or to a printing operation level of −3 mbar. Pressure fluctuations may thereby possibly be compensated solely by one of the two transport means 411, 421. A PID control may be used to adjust the physical pressure. For example, the ink supply system 400 may include at least one pressure sensor 408 that is configured to detect sensor data with regard to the physical pressure at one or more print heads 103. The first and/or the second transport means 411, 421 may then be operated depending on the sensor data of the pressure sensor 408, in particular in order to set the physical pressure to a target value. Interruptions of the physical pressure of the ink 202 due to the operation of one or more print heads 103 may thus be compensated.

An ink supply system 400 for an inkjet printing device 100 is thus described. In an exemplary embodiment, the printing device (printer) 100 includes a print bar 102 having a plurality of print heads 103 that is arranged at a corresponding plurality of different positions along the longitudinal direction or along the longitudinal axis of the print bar 102, between the first side 405 and the second side 406 of the print bar 102. The longitudinal axis or longitudinal direction of the print bar 102 may thereby travel transversal to the transport direction 1 of a recording medium 120 of the printing device 100. The print heads 103 of the print bar 102 may be arranged one after another in one or more rows along the longitudinal direction or longitudinal axis. The print heads 103 of different rows may thereby at least partially overlap. The different positions of the print heads 103 may be arranged at different locations of the longitudinal axis.

In an exemplary embodiment, the ink supply system 400 includes a first and a second supply line 416, 426 that respectively travel along the longitudinal direction. The first and second supply line 416, 426 may thereby travel parallel to one another and/or parallel to the print heads 103.

The print bar 102 may have a front side and a rear side in relation to a transverse direction transversal to the longitudinal direction of the print bar 102. The transverse direction may thereby correspond to the transport direction 1 of a recording medium that is printed to by the print bar 102. The plurality of print heads 103 of the print bar 102 may be arranged between the front side and the rear side. The first supply line 416 may thereby be arranged closer to the front side, relative to the transverse direction, than the second supply line 426, and/or the second supply line 426 may thereby be arranged closer to the front side, relative to the transverse direction, than the first supply line 416. In particular, the plurality of print heads 103 may be arranged between the first supply line 416 and the second supply line 426.

Moreover, in an exemplary embodiment, the ink supply system 400 includes a plurality of connecting lines 402 (also referred to in this document as cross lines) that respectively connect the first and second supply line 416. 426 with one another at the corresponding plurality of different positions. The plurality of connecting lines 403 is configured to supply ink 202 from the first and/or the second supply line 416, 426 to the corresponding plurality of print heads 103. The connecting lines 403 may thereby be arranged such that the plurality of connecting lines 403 travels past the plurality of print heads 103 and/or across the plurality of print heads 103 along the transverse direction. In particular, the first and second supply line 416, 426 may be connected with one another at the plurality of different positions by the corresponding plurality of connecting lines 403 that respectively travel along the transverse direction. The individual print heads 103 may thereby be arranged at or below a respective connecting line 403. The individual print heads 103 may thus be efficiently connected to the corresponding connecting lines 403.

In an exemplary embodiment, the plurality of connecting lines 403 may be designed to respectively produce, at the corresponding plurality of positions, a pressure equalization, or at least a pressure compensation, between the physical pressure of ink 202 in the first supply line 416 and the physical pressure of ink 202 in the second supply line 426. For this purpose, the connecting lines 403 may have a sufficiently large cross section (adapted to the viscosity of the ink 202 and/or to the quantity of ink 202 required for the printing operation) in order to enable a pressure compensation or a pressure equalization.

Moreover, the ink supply system 400 includes at least one container 401 for ink 202. Furthermore, the ink supply system 400 includes at least one transport means 411, 421 (in particular at least one pump) that is configured to transport (in particular to pump) ink 202 along the first flow direction 412 from the container 401 from the first side 405 to the second side 406, via the first supply line 416, and along the second flow direction 422 from the second side 406 to the first side 405, via the second supply line 426.

In an exemplary embodiment, the ink supply system 400 for a print bar 102 of an inkjet printing device 100 includes two supply lines 416, 426 that travel along the longitudinal axis of the print bar 102 and direct ink 202 with opposite flow direction 412, 422. The print heads 103 of the print bar 102 are respectively connected to both supply lines 416, 426 via a connecting line 403 in order to produce a uniform physical pressure on ink 202 in the print heads 103 of the print bar 102. In particular, a uniform mean hydraulic pressure may be produced in all print heads 103 via the opposite flow directions 412, 422 in the two supply lines 416, 426. Nozzle failures may thus be reliably avoided in the different print heads 103 of a print bar 102.

The ink supply system 400 may possibly have a single ink loop that includes both the first supply line 416 and the second supply line 426. For example, the ink 202 may first be pumped along the first flow direction 412 from the first side 405 to the second side 406, via the first supply line 416, and from there along the second flow direction 422 from the second side 406 to the first side 405, via the second supply line 426, wherein the two supply lines 416, 426 are connected with one another via the plurality of connecting lines 403. The infeed points to both supply lines 416, 426 are thus diametrically opposed. The two supply lines 416, 426 may thus be efficiently supplied with ink 202 using a single transport means 411, 421 (in particular using a single pump).

Alternatively, in an exemplary embodiment, the ink supply system 400 include a first ink loop 410 that has the first supply line 416 and a first transport means 411 in order to transport ink 202 from the container 401, through the first supply line 416, and at least in part back to the container 401. Furthermore, the ink supply system 400 may include a second ink loop 420 that has the second supply line 426 and a second transport means 421 in order to transport ink 202 from the container 401, through the first supply line 426, and at least in part back to the container 401. By providing two separate ink loops 410, 420 that are connected with one another via the connecting lines 403, the physical pressure of ink 202 at the print heads 103 may be adjusted with increased precision.

As has already been presented above, the ink supply system 400 has (at least) one respective, dedicated connecting line 403 for each print head 103. At the position of a print head 103, a respective connecting line 403 may thereby travel transversal to the longitudinal direction of the print bar 103 above the print head 103 in order to connect the first supply line 416 and the second supply line 426 with one another. In particular, at least one respective connecting line 403 may in particular travel transversally over the respective print head 103 for each print head 103 of the print bar 102.

The individual print heads 103 may thus be reliably supplied with ink 202, so that the ink 202 in the different print heads 103 exhibits a consistent or uniform mean physical pressure or hydraulic pressure.

In an exemplary embodiment, the connecting lines 403 respectively include a connector 404 for coupling of the respective connecting line 403 with the ink channel of a respective print head 103 so that ink 202 may flow from the respective connecting line 403 into the ink channel of the respective print head 103. The connector 404 of a connecting line 403 may thereby be arranged centrally between the first supply line 416 and the second supply line 426 in order to enable an optimally reliable equalization between the physical pressure in the first supply line 416 and the physical pressure in the second supply line 426.

In an exemplary embodiment, the ink supply system 400 includes a pressure sensor 408 that is configured to detect sensor data with regard to the physical pressure of ink 202 in the first and/or the second supply line 416, 426, and/or in at least one of the plurality of connecting lines 403. Furthermore, the ink supply system 400 may include a controller 101 that is configured to operate transport means (pumps) 411, 421 depending on the sensor data in order to set the physical pressure to a target value, in particular to regulate to a target value. In particular, the physical pressure at the print heads 103 and/or in the connecting lines 403 may be set or regulated to a target value. For example, the pressure sensor 408 may be arranged at the connector 404 of a connecting line 403 for a print head 103. By taking into account sensor data of one or more pressure sensors 408, the physical pressure in the print heads 103 of a print bar 102 may be precisely adjusted in order to enable a reliable and consistent operation of the print heads 103.

In an exemplary embodiment, the ink supply system 400 may include a degasser 200 that is configured to reduce the gas content of ink 202 for the plurality of print heads 103. Alternatively or additionally, the ink supply system 400 may include a filter 402 that is configured to filter ink 202 for the plurality of print heads 103. The degasser 200 and/or the filter 402 may, for example, be arranged in a (possibly precisely one) loop 410, 420 of the ink supply system 400. The reliability of the print heads 103 may be increased via the degassing and/or filtering of the ink 202 that is used.

Furthermore, in this document an inkjet printing device 100 is described that includes at least one print bar 102 having a plurality of print heads 103 that are arranged at different positions along the longitudinal direction of the print bar 102. A printing device 100 typically includes a plurality of print bars 102. Moreover, the printing device 100 includes at least one of the ink supply systems 400 described in this document. A dedicated ink supply system 400 may thereby be provided for each print bar 102 in order to supply the respective print bar 102 with ink 202.

Via the aspects described in this document, consistent conditions for the ink supply in the different print heads 103 of a print bar 102 may be reliably provided. Furthermore, the described ink supply system 400 enables the supply lines 416, 426 to be comfortably and efficiently serviced for the maintenance of a printing device 100. Moreover, given the system 400 described in this document, a negative pressure vessel 201 is typically omitted, such that an efficient ink supply is enabled.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
21, 22 nozzle
31, 32 column (of the print image)
100 printing device (printer)
101 controller
102 print bar
103 print head
120 recording medium
140 print group
200 degasser (degassing device)
201 (negative pressure) vessel
202 ink
203 transport pump
204 (storage) container
205 transport pump
206, 208 ink supply system
214 pressure pump
301, 302 pressure curve over time
400 ink supply system
401 ink container
402 filter
403 connecting line
405, 406 sides (of the print bar)
408 pressure sensor
410, 420 ink loop
411, 421 transport pump
412, 422 flow direction
415, 425 pressure curve
416, 426 supply line

The invention claimed is:

1. An ink supply system for an inkjet printer including a print bar having a plurality of print heads arranged at a plurality of different positions along a longitudinal direction of the print bar between a first side and a second side of the print bar, the ink supply system comprising:

first and second supply lines that respectively travel along the longitudinal direction;

a plurality of connecting lines that respectively connect the first supply line and the second supply line to one another at the different positions of the plurality of print heads, the plurality of connecting lines being configured to supply ink from the first supply line and/or the second supply line to the plurality of print heads;

at least one container for ink; and at least one transport pump configured to convey ink from the container along a first flow direction via the first supply line, from the first side to the second side, and along a second flow direction opposite the first flow direction via the second supply line, from the second side to the first side.

2. The ink supply system according to claim 1, further comprising:

a first ink loop that includes the first supply line and a first transport pump configured to convey the ink from the container via the first supply line, and at least in part back to the container; and a second ink loop that includes the second supply line and a second transport pump configured to convey ink from the container via the first supply line, and at least in part back to the container.

3. The ink supply system according to claim 2, wherein:

the print bar includes a front side and a rear side relative to a transverse direction transversal to the longitudinal direction;

the print heads are arranged between the front side and the rear side;

the first supply line is arranged closer to the front side than the second supply line, in relation to the transverse direction, and the second supply line is arranged closer to the rear side than the first supply line, in relation to the transverse direction; and the plurality of connecting lines travel along the transverse direction, between the first supply line and the second supply line, such that the plurality of connecting lines respectively travel past at least one print head or across at least one print head.

4. The ink supply system according to claim 1, wherein:

the print bar includes a front side and a rear side relative to a transverse direction transversal to the longitudinal direction;

the print heads are arranged between the front side and the rear side;

the first supply line is arranged closer to the front side than the second supply line, in relation to the transverse direction, and the second supply line is arranged closer to the rear side than the first supply line, in relation to the transverse direction; and the plurality of connecting lines travel along the transverse direction, between the first supply line and the second supply line, such that the plurality of connecting lines respectively travel past at least one print head or across at least one print head.

5. The ink supply system according to claim 1, wherein:

the plurality of print heads of the print bar are arranged one after another at the different positions in one or more rows along the longitudinal direction; and at the respective different positions of the plurality of print heads, a respective connecting line, which connects the first supply line and the second supply line to one another, travels transversal to the longitudinal direction across the respective print head of the plurality of print heads.

6. The ink supply system according to claim 1, wherein, at the different positions, the plurality of connecting lines are configured to produce a respective pressure equalization or a pressure compensation between a physical pressure of the ink in the first supply line and a physical pressure of the ink in the second supply line.

7. The ink supply system according to claim 1, wherein:

the plurality of connecting lines respectively travel orthogonal to the first and the second supply lines;

the plurality of connecting lines travel parallel to one another; or the first and the second supply lines travel parallel to one another.

8. The ink supply system according to claim 1, wherein:

the plurality of connecting lines respectively travel orthogonal to the first and the second supply lines;

the plurality of connecting lines travel parallel to one another; and the first and the second supply lines travel parallel to one another.

9. The ink supply system according to claim 1, further comprising:

a pressure sensor configured to:

detect a physical pressure of the ink in: the first supply line, the second supply line, and/or at least one of the plurality of connecting lines; and generate a sensor data signal corresponding to the detected physical pressure; and a controller configured to control the transport pump based on the sensor data signal to adjust or regulate the physical pressure at the plurality of print heads.

10. The ink supply system according to claim 1, further comprising:

a pressure sensor configured to:

detect a physical pressure of the ink within the inkjet printer; and generate a sensor data signal corresponding to the detected physical pressure; and a controller configured to control the transport pump based on the sensor data signal to adjust or regulate the physical pressure at the plurality of print heads.

11. The ink supply system according to claim 10 wherein the pressure sensor is configured to detect the physical pressure of the ink in the first supply line, the second supply line, and at least one of the plurality of connecting lines.

12. The ink supply system according to claim 1, wherein a connecting line of the plurality of connecting lines for a print head of the plurality of print heads comprises a connector configured to couple the connecting line with an ink channel of the print head such that the ink flows from the connecting line into the ink channel of the print head.

13. The ink supply system according to claim 1, further comprising:

at least one degasser configured to reduce a gas content of the ink for the plurality of print heads; or at least one filter configured to filter the ink for the plurality of print heads.

14. The ink supply system according to claim 1, further comprising:

at least one degasser configured to reduce a gas content of the ink for the plurality of print heads; and at least one filter configured to filter the ink for the plurality of print heads.

15. An inkjet printer, comprising:

a plurality of print heads arranged at different positions; and an ink supply system that is configured to supply the plurality of print heads with ink, wherein the ink system includes:

first and second supply lines;

a plurality of connecting lines that respectively connect the first supply line and the second supply line to one another at the different positions of the plurality of print heads, the plurality of connecting lines being configured to supply ink from the first supply line and/or the second supply line to the plurality of print heads; and a transport pump configured to convey the ink from an ink source along a first flow direction via the first supply line, and along a second flow direction opposite the first flow direction via the second supply line.

16. The inkjet printer according to claim 15, comprising a print bar that includes the plurality of print heads, which are the arranged at the different positions along a longitudinal direction of the print bar.

17. The inkjet printer according to claim 16, wherein the first and second supply lines respectively travel along the longitudinal direction.

* * * * *